US009654856B1

(12) United States Patent
Horbach

(10) Patent No.: US 9,654,856 B1
(45) Date of Patent: May 16, 2017

(54) NOISE-CANCELING CONCHA HEADPHONE

(71) Applicant: Harman International Industries, Inc., Stamford, CT (US)

(72) Inventor: Ulrich Horbach, Canyon Country, CA (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/982,421

(22) Filed: Dec. 29, 2015

(51) Int. Cl.

| | |
|---|---|
| ***H04R 1/10*** | (2006.01) |
| ***H04R 7/12*** | (2006.01) |
| ***H04R 1/28*** | (2006.01) |
| ***H04R 3/04*** | (2006.01) |
| ***G10K 11/178*** | (2006.01) |

(52) U.S. Cl.
CPC ..... *H04R 1/1016* (2013.01); *G10K 11/1782* (2013.01); *H04R 1/105* (2013.01); *H04R 1/1083* (2013.01); *H04R 1/2823* (2013.01); *H04R 3/04* (2013.01); *H04R 7/127* (2013.01); *H04R 2460/01* (2013.01)

(58) Field of Classification Search
CPC ..... H04R 1/1016; H04R 3/04; H04R 1/1083; H04R 1/105; H04R 7/127; H04R 1/2823; H04R 2460/01; G10K 11/1782
See application file for complete search history.

(56) References Cited

U.S. PATENT DOCUMENTS

| | | | | |
|---|---|---|---|---|
| 6,683,965 | B1 * | 1/2004 | Sapiejewski ..... | H04R 1/1083 381/370 |
| 8,355,522 | B2 | 1/2013 | Annunziato et al. | |
| D712,884 | S | 9/2014 | Krauss et al. | |
| 2009/0161885 | A1 | 6/2009 | Donaldson et al. | |
| 2014/0363010 | A1 * | 12/2014 | Christopher ..... | H04R 1/1083 381/71.6 |

OTHER PUBLICATIONS

International Application No. PCT/US2014/053509 filed Aug. 29, 2014.

* cited by examiner

*Primary Examiner* — Muhammad N Edun
(74) *Attorney, Agent, or Firm* — Brooks Kushman P.C.

(57) ABSTRACT

A headphone assembly is described having a concha-style headphone including an earpiece at least partially covered in dual foam and a headband for providing a clamping force sufficient to the seal the concha of a user's with the earpiece. The earpiece may be shaped to fit different concha sizes and shapes to provide a universal fit. The dual foam may include a layer of memory foam underneath acoustically-transparent, porous outer foam. The earpiece may further include a transducer and at least one microphone positioned with the earpiece to receive sound radiated by the transducer and noise. The headphone assembly may be equipped with an active noise-canceling (ANC) control system configured to receive an audio input signal from an audio source and provide a filtered audio output signal to the transducer based on part on a perceived frequency response of the headphone as measured by the microphone.

19 Claims, 6 Drawing Sheets

NOISE-CANCELING CONCHA HEADPHONE

TECHNICAL FIELD

One or more embodiments of the present disclosure generally relate to noise-canceling headphones and to concha-style headphones.

BACKGROUND

The continuing miniaturization of electronic devices has led to a variety of portable audio devices that deliver audio to a listener via headphones. The miniaturization of electronics has also led to smaller and smaller headphones that produce high quality sound. Some headphones now include noise cancellation systems that include microphones for obtaining external sound data and a controller for reducing or cancelling the external sounds that are generated in the user's environment.

Ear canal shapes, angles and sizes vary greatly among different persons. Many users feel uncomfortable to wear conventional in-ear headphones despite of different ear tips that come with the headphone products. Air seal, which is essential for good low frequency extension, is poor in many cases. Also, in-ear headphones tend to loosen or even fall off. Around-the-ear headphones are usually heavy, bulky and unsuitable for portable applications. On-ear headphones suffer from poor air seal, which limits their low-frequency performance and overall audio quality.

SUMMARY

One or more embodiments of the present disclosure are directed to a headphone assembly comprising a headband and at least one headphone attached to an end of the headband. The headband may include an earpiece shaped and positioned for placement into a concha of a user's ear. The headband may further include memory foam attached to the earpiece and a porous, outer foam disposed on the earpiece over top the memory foam. The headband may provide a clamping force that creates an air seal between the headphone and corresponding concha without the headphone intruding into the a user's ear canal.

According to one or more embodiments, the outer foam may be acoustically transparent. The earpiece may include a transducer and at least one microphone in proximity to the transducer to receive sound radiated by the transducer and noise. The headphone assembly may further include an active noise canceling (ANC) control system configured to receive an audio input signal from an audio source and provide a filtered audio output signal to the transducer based in part on a perceived frequency response of the headphone as measured by the microphone.

The earpiece may include an inner first portion and an outer second portion disposed between the inner first portion and the end of the headphone. The inner first portion may define a first chamber of the earpiece and the outer second portion may define a second chamber of the earpiece. The memory foam may be a self-adhesive strip of memory foam wrapped around the first portion of the earpiece. Moreover, the inner first portion of the earpiece may be shaped to fit different concha sizes and shapes to provide a universal fit. The inner first portion of the earpiece may also include a perforated nozzle to provide a sound output port.

One or more additional embodiments of the present disclosure are directed to a sound system comprising a headphone assembly and an active noise canceling (ANC) control system. The headphone assembly may include a headband and at least one headphone attached to an end of the headband. The headphone may include an earpiece shaped and positioned for placement into a concha of a user's ear. The earpiece may have an inner first portion and an outer second portion disposed between the first portion and the end of the headphone. The inner first portion may define a first chamber of the earpiece and the outer second portion may define a second chamber of the earpiece.

The headphone may further include a transducer disposed in the second chamber and supported by the outer second portion of the earpiece. A microphone may be disposed in the first chamber and coupled to the inner first portion of the earpiece. The microphone may be positioned in the first chamber to receive sound radiated by the transducer and noise. Memory foam may be adhesively attached to the inner first portion of the earpiece and a porous, outer foam may be disposed on the inner first portion of the earpiece over top the memory foam. The ANC control system may be configured to receive an audio input signal from an audio source and to provide a filtered audio output signal to the transducer based in part on a perceived frequency response of the headphone as measured by the microphone. Moreover, the headband may provide a clamping force that creates an air seal between the headphone and corresponding concha.

According to one or more embodiments, a volume around the microphone may be occupied with acoustic foam to dampen internal reflections. The second chamber may include damping material to dampen a rear acoustic output of the transducer. The transducer may include a cone formed from a rigid paper membrane to achieve pistonic motion within an audio band. The outer second portion of the earpiece may include a plurality of vent holes for bass tuning. The plurality of vent holes may be lined with acoustic resistance paper.

Additionally, the ANC control system may include a side-chain filter configured to pass the high-frequency portion of the audio input signal. The ANC control system may further include a loop filter configured to generate the filtered audio output signal based on the high-pass filtered audio input signal and a feedback signal indicative of sound received by the microphone, and to provide the filtered audio output signal to the transducer. The side-chain filter may be a high-pass filter.

One or more additional embodiments of the present disclosure are directed to a sound system comprising a headphone assembly including at least one concha headphone having an earpiece shaped for placement within a concha of a user's ear. The headphone assembly may further include a headband that provides a clamping force to seal the user's concha with the headphone. The earpiece may include a transducer and at least one microphone.

The sound system may further comprise a side-chain filter configured to high-pass filter an audio input signal and a loop filter configured to generate a filtered audio output signal based on the high-pass filtered audio input signal and a feedback signal indicative of sound received by the at least one microphone. The loop filter may provide the filtered audio output signal to the transducer.

According to one or more embodiments, the side-chain filter is a high-pass filter. Further, the at least one microphone may be positioned inside the earpiece to receive sound radiated by the transducer and noise. The earpiece may be shaped to fit different concha sizes and shapes to provide a universal fit.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
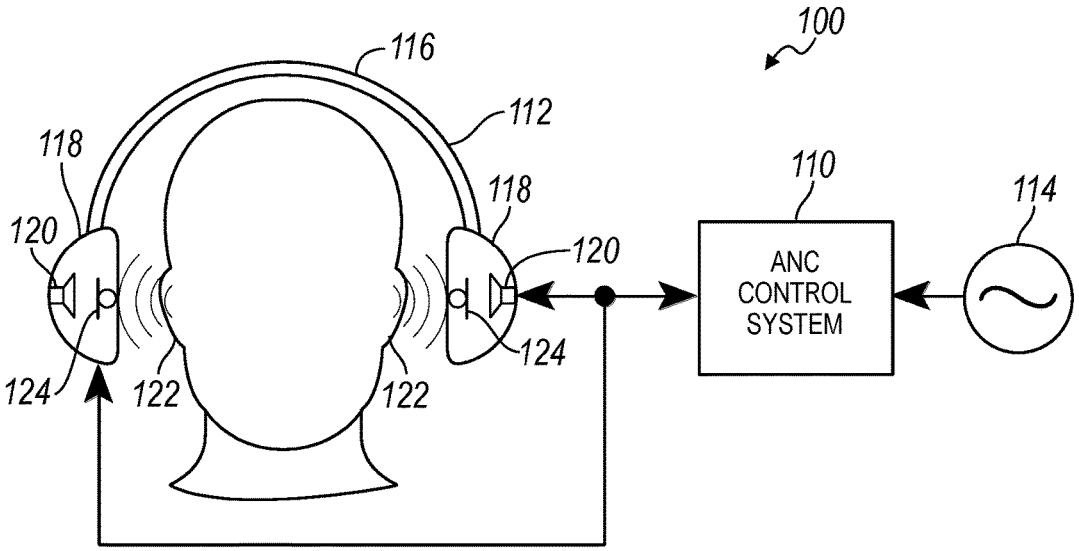
FIG. 1 is a simplified, exemplary schematic diagram illustrating a sound system including a noise cancelling control system connected to headphones and generating sound waves to a user, according to one or more embodiments of the present disclosure.

With reference to FIG. 1, a sound system 100 is illustrated in accordance with one or more embodiments of the present disclosure. The sound system 100 may include an active noise cancelling (ANC) control system 110 and a headphone assembly 112. The ANC control system 110 may receive an audio input signal from an audio source 114 and may provide an audio output signal to the headphone assembly 112. The headphone assembly 112 may include a headband 116 and a pair of headphones 118. Each headphone 118 may include a transducer 120, or driver, that is positioned in proximity to a user's ear 122. The transducer 120 receives the audio output signal and generates audible sound. Each headphone 118 may also include one or more microphones 124 that are positioned between the transducer 120 and the ear 122. Although shown in FIG. 1 as having a pair of headphones 118, the headphone assembly 112 may include a headband 116 and a single headphone 118.

FIG. 1 depicts a schematic representation of sound system 100. The illustrated elements are also depicted schematically. For instance, the headphones 118 are depicted such that transducer 120 and microphone 124 can be illustrated schematically. Thus, the size and shape of the headphones 118 is not intended to limit the present disclosure to a particular headphone type. Rather, one or more embodiments of the present disclosure may be employed using other types of headphones, such as concha (also referred to as intra-concha) headphones, as will be described in greater detail.

Figure 2:
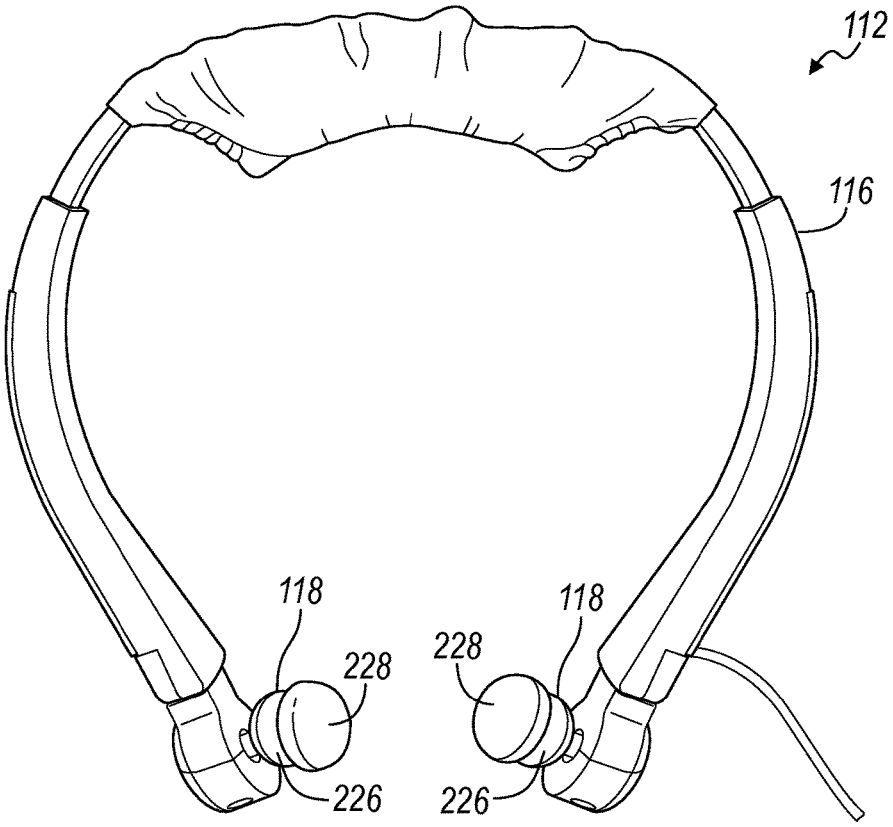
FIG. 2 is an illustration of an exemplary headphone assembly, according to one or more embodiments of the present disclosure.
Figure 3:
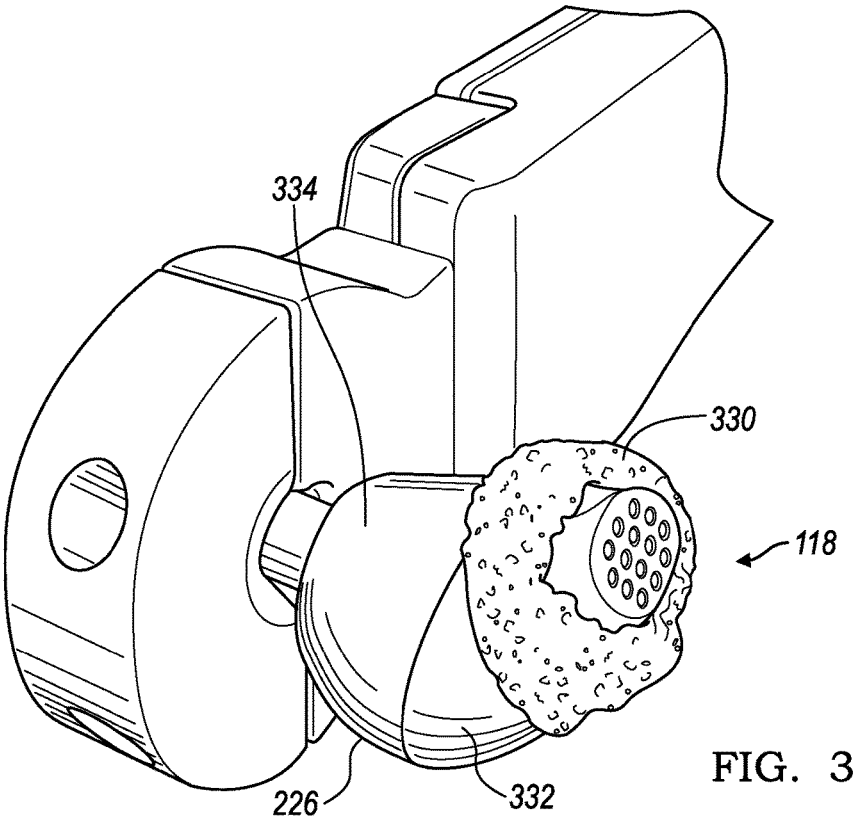
FIG. 3 is a perspective view of an exemplary headphone, according to one or more embodiments of the present disclosure.

FIG. 2 illustrates the headphone assembly 112 in greater detail. According to one or more embodiments, each headphone 118 may be a concha headphone. A concha headphone is a physical headphone type that rests in the inner bowl (concha) of the ear just outside the ear canal entrance. A concha headphone may also be referred to as an earphone because it is small enough to stick in a user's ear. Unlike insert earphones (or in-ear monitors), however, concha headphones or earphones are not inserted into the ear canal. Each headphone 118 may include an ear piece 226 and a soft, porous outer foam 228 that is acoustically transparent to provide comfort. Underneath the outer foam 228, memory foam 330 may be wrapped around the ear piece 226 as shown in FIG. 3. The memory foam 330 may be a self-adhesive strip or pre-cut piece.

The headphone 118 seals in the concha without intruding into a user's ear canal. Air seal is essential for good low frequency extension and overall audio quality, but is difficult to achieve in traditional concha-style headphones. A seal may be achieved with an optimally shaped ear piece 226 and the use of the combination of the memory foam 330 and the porous, acoustically transparent outer foam 228. According to one or more embodiments of the present disclosure, the ear piece 226 with dual foam may be a replaceable and come in different sizes. A light headband, such as headband 116, may be used to provide the necessary clamping force for an adequate seal. Accordingly, the headphones 118 can deliver excellent sound quality, bass extension and comfort.

Referring back to FIG. 2, the headband 116 may contain electronic devices (not shown), such as a digital signal processor with headphone amplifier, a Bluetooth receiver, a gyroscope used for head tracking, a rechargeable battery, and user controls (buttons). The headband 116 may also contain the ANC control system 110.

FIG. 3 shows a headphone 118 with the outer foam 228 removed to better illustrate the memory foam 330. The ear piece 226 may comprise multiple portions, as will be described in greater detail with respect to FIG. 5. For instance, the ear piece 226 may include an inner, first portion 332 and an outer, second portion 334. As shown, the memory foam 330 may be wrapped around the first portion 332. When in use, the first portion 332 of the ear piece 226 may generally reside in the concha of a user's ear.

Figure 4:
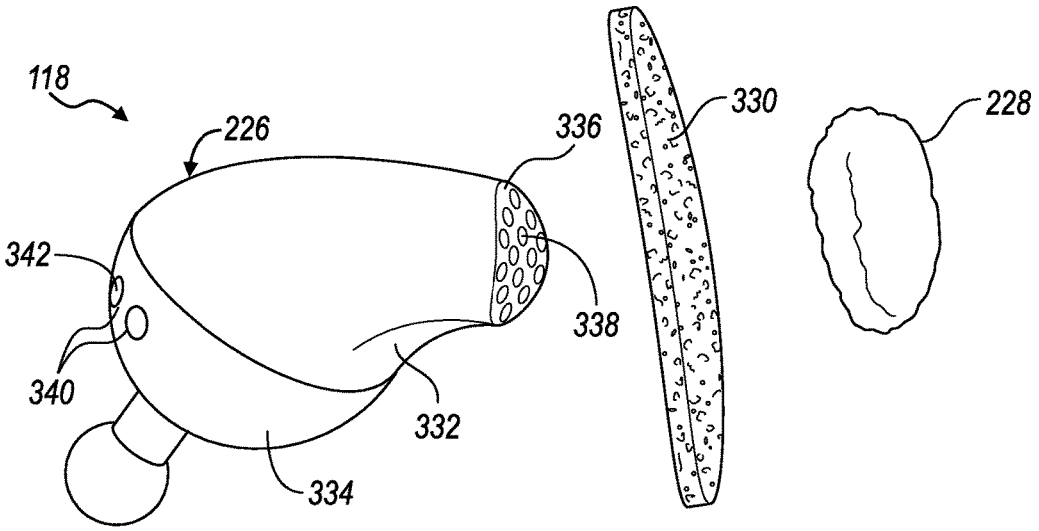
FIG. 4 is a simplified, exemplary exploded view of a headphone, according to one or more embodiments of the present disclosure.

FIG. 4 is an exploded view of a headphone 118. As shown, the headphone 118 includes an earpiece 226, a piece of memory foam 330, and a piece of outer foam 228 for covering the memory foam and at least a portion of the earpiece (e.g., the first portion 332). The first portion 332 of the earpiece 226 may be shaped to fit different concha sizes and shapes, thereby providing a universal fit. The headband 116 (FIG. 2) in combination with the contoured earpiece 226 and memory foam 330 can provide a satisfactory air seal that is not traditionally achieved in a conch-style headphone. The first portion 332 may include a nozzle 336 that operates as a sound output port. Accordingly, the nozzle 336 may include a perforated output 338 allowing sound waves to easily pass. The second portion 334 may include multiple vent holes 340 with attached acoustic resistance. For example, acoustic resistance paper 342 may be inserted or otherwise applied to the inside of the second portion 334 to cover the vent holes 340.

Figure 5:
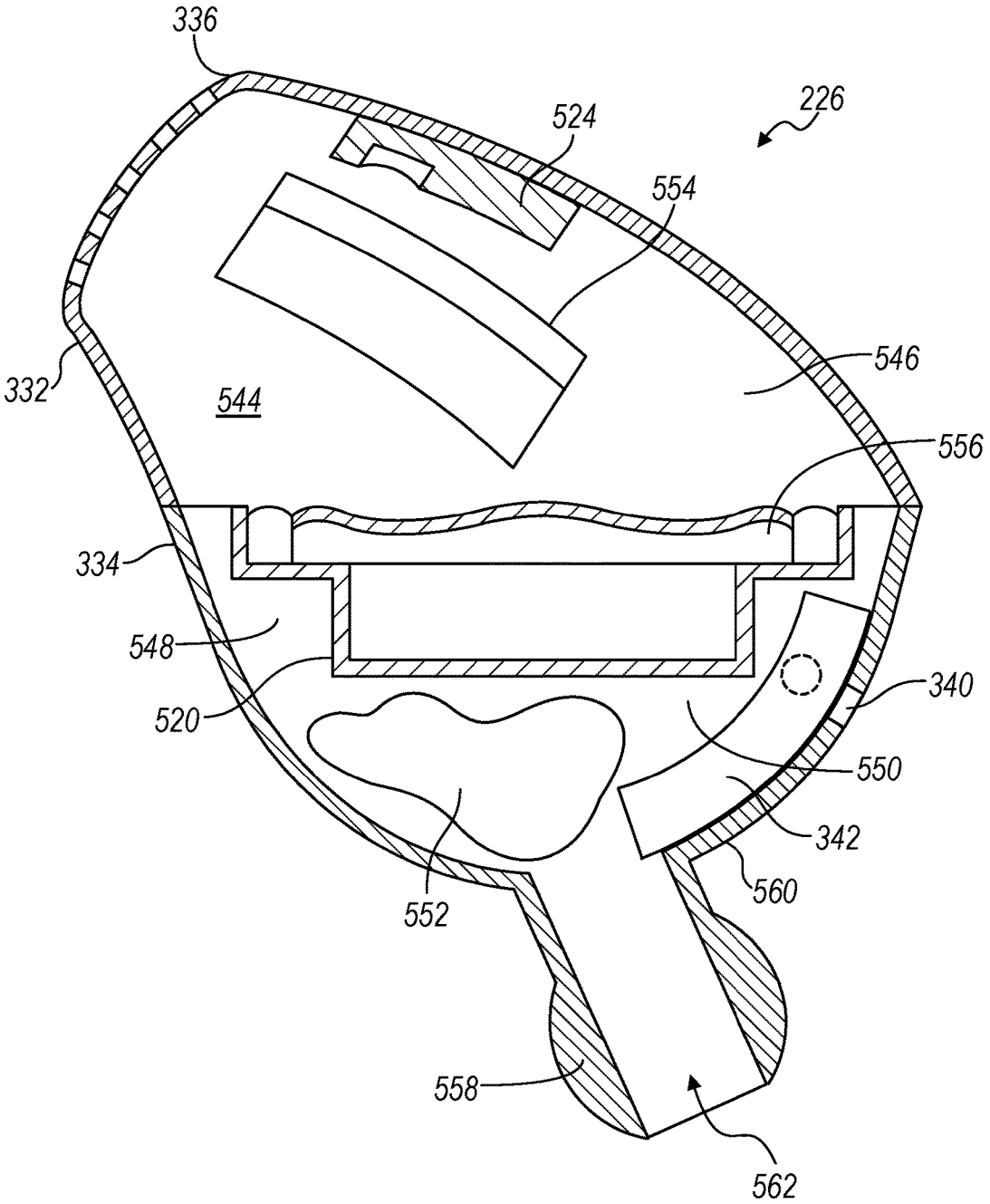
FIG. 5 is a side, cross-sectional view of an earpiece, according to one or more embodiments of the present disclosure.

FIG. 5 is a cross-sectional view of the earpiece 226 according to one or more embodiments of the present disclosure. The first portion 332 may also include a first chamber 544 providing a front acoustic volume 546. The second portion 334 of the earpiece 226 may include a second chamber 548 providing a rear acoustic volume 550. The second portion 334 may house a driver or transducer 520. The driver or transducer 520 is adapted to provide accurate pistonic motion throughout the audible band. The transducer 520 may include a small surround and a membrane cone 556 with center dome, formed of rigid materials such as fiber-reinforced paper, carbon, bio-cellulose, or anodized aluminum or titanium, or beryllium. This leads to a smooth frequency response, which is essential for good sound quality and functioning noise canceling and error feedback.

The second portion 334 may provide the necessary acoustic volume and bass tuning through the multiple vent holes 340 with the attached acoustic resistance paper 342. The second portion 334 may further include damping material 552 inserted into the cavity of the second chamber 548 to dampen the rear acoustic output of the transducer 520. As examples, the damping material 552 may be a piece of DACRON® (i.e., polyethylene terephthalate), acoustic foam, or fiberglass.

The first portion 332 of the earpiece 226 may further include at least one micro-electro-mechanical systems (MEMS) microphone 524. The microphone 524 may be located near the nozzle 336 and may face in the general direction of the transducer 520. The microphone 524 may be employed for acoustic noise canceling, error correction, as well as probing the perceived acoustic frequency response, which may be equalized by an inverse filter. The area around the microphone 524 may be covered with acoustic foam 554 to dampen internal reflections. As mentioned previously, the microphone 524 is not just used for noise-canceling, but may also provide auto-calibration by measuring and equalizing the perceived frequency response, which can vary greatly due to the shape of individual concha and ear canals.

The second portion 334 may also include a fixture 558 at an end 560 of the earpiece 226 opposite the nozzle 336. The fixture 558 may connect the earpiece 226 to the headband 116 and include a cable canal 562 for allowing a cable (not shown) to connect to at least the transducer 520. According to one or more embodiments, the cable may also connect to the microphone 524, particularly if the ANC control system 110 is located outside of the earpiece such as in the headband 116. According to one or more other embodiments, the ANC control system 110 may be disposed within the earpiece 226.

Figure 6:
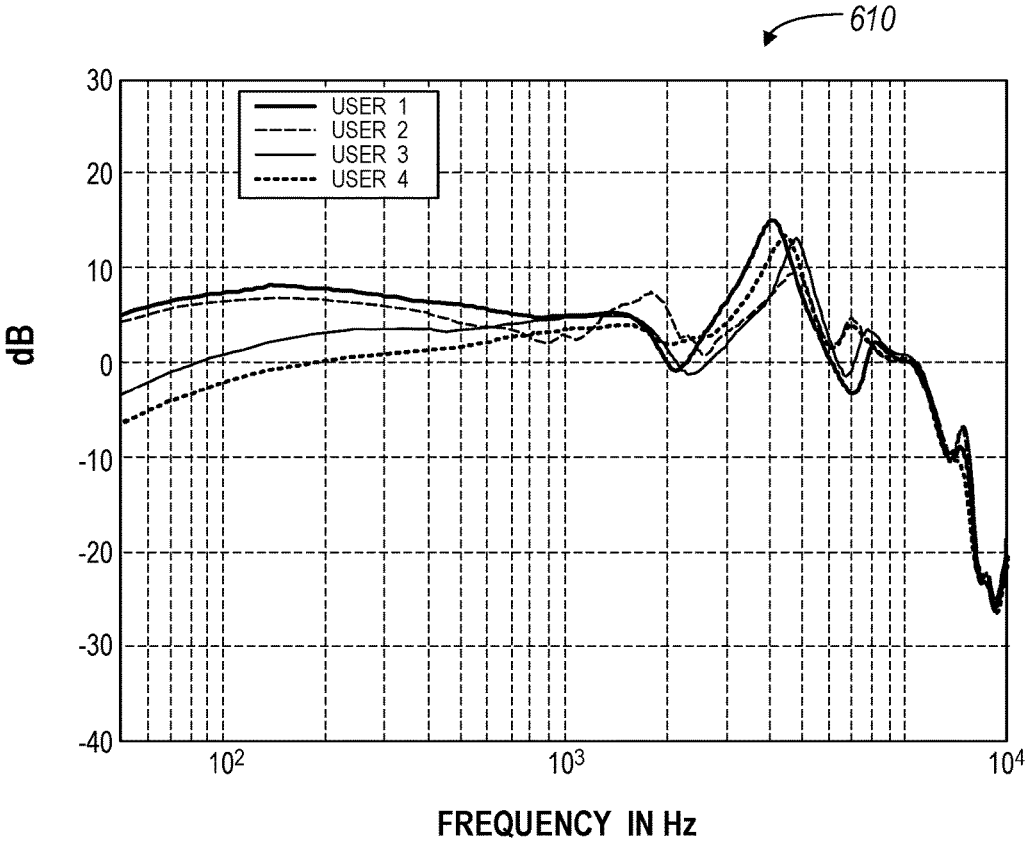
FIG. 6 is a graph illustrating a frequency response of an exemplary headphone worn by multiple users as measured by a built-in microphone, according to one or more embodiments of the present disclosure.

FIG. 6 is a graph illustrating an exemplary frequency response 610 of the headphones 118 measured with the built-in microphone 524 when worn by four different persons. The nearly flat response down to low frequencies (e.g., 50 Hz) is indicative of a sufficient air seal in the concha. The remaining deviations may be eliminated by an acoustic error feedback scheme, such as depicted in FIG. 7.

Figure 7:
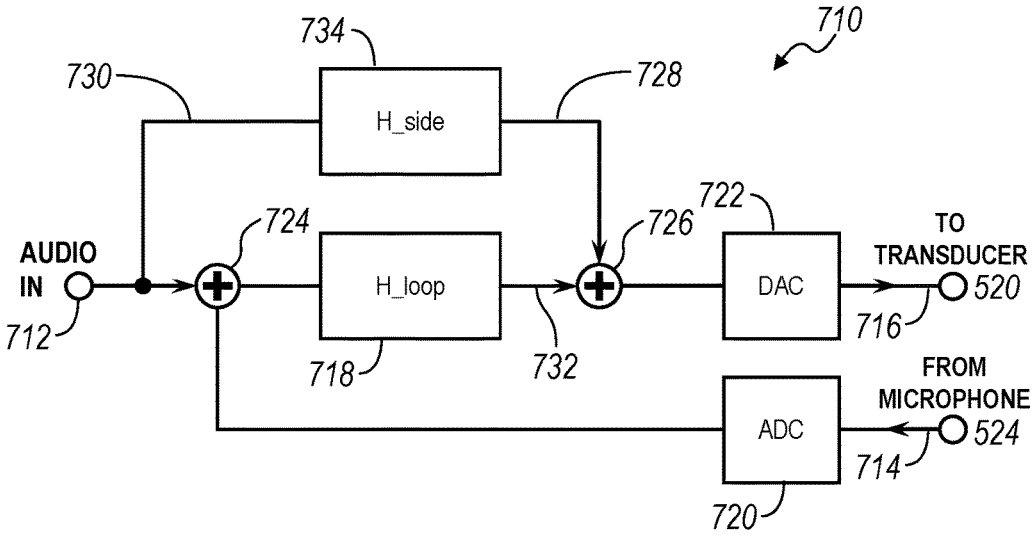
FIG. 7 is a schematic block diagram of a control loop within an active noise-canceling control system, according to one or more embodiments of the present disclosure.

Referring now to FIG. 7, a noise canceling and error reduction control loop 710 is illustrated in accordance with one or more embodiments of the present disclosure. The control loop 710 may be included in the ANC control system 110. The control loop 710 may include an audio input 712 from an audio source, such as audio source 114. The control loop 710 may also include a microphone input 714 and a filtered audio output signal 716. The microphone input 714 may be a feedback signal indicative of sound received by the at least one microphone 524. The filtered audio output signal 716 may be provided to transducer 520 (not shown).

The control loop may also include a loop filter 718 (H_loop), which may be implemented as a digital filter. The loop filter 718 may utilize a low latency analog-to-digital converter (ADC) 720 and a low latency digital-to-analog converter (DAC) 722. The loop filter 718 may also utilize a sufficiently high sampling rate, such as 384 KHz. Other practical sample rates may be in the range from 192 KHz to 3.072 MHz, which is between 4 and 64 times the nominal sample rate of 48 KHz. Additional alternative sampling rates may range from 176.4 KHz to 2.822 MHz if the base rate is 44.1 KHz. The microphone input 714 may be converted from analog to digital by the ADC 720, and then summed with the audio input 712 at a first summation node 724. The result of the first summation node 724 is fed to the loop filter 718.

The ANC control system 110 may generate the filtered audio output signal 716 at second summation node 726. A high-pass filtered audio input signal 728 is provided to the second summation node 726 along a side-chain, or feedforward path 730. The second summation node 726 may combine the high-pass filtered audio input signal with a loop filter output 732, with the result being fed to the DAC 722 and output as the filtered audio output signal 716 to the transducer 520. According to one or more embodiments, the feedforward path 730 may include a side chain filter 734 (H-side) for generating the high-pass filtered audio input signal. Accordingly, the side chain filter 734 may be a high-pass filter that functions to add the high frequency portion of the audio input signal back at the output.

More details about noise canceling and error reducing filter design, in particular the loop filter and side chain filter described in FIG. 7, are disclosed in International Application Number PCT/US2014/053509, filed Aug. 29, 2014, which is hereby incorporated by reference. High frequency resonances above 1 KHz, like the one around 4 KHz in FIG. 6 of the present disclosure, may be equalized by an equalization (EQ) filter (not shown). The EQ filter may be designed with an auto-calibration method, as is also disclosed International Application Number PCT/US2014/053509.

Figure 8:
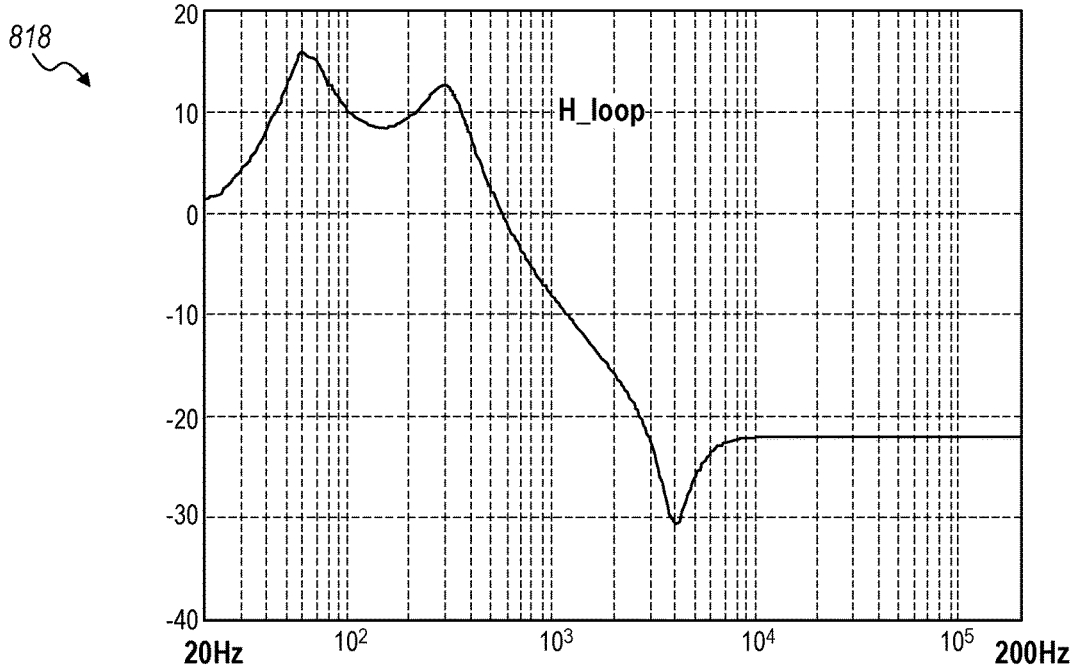
FIG. 8 is a graph illustrating an open loop frequency response of a loop filter, according to one or more embodiments of the present disclosure.
Figure 9:
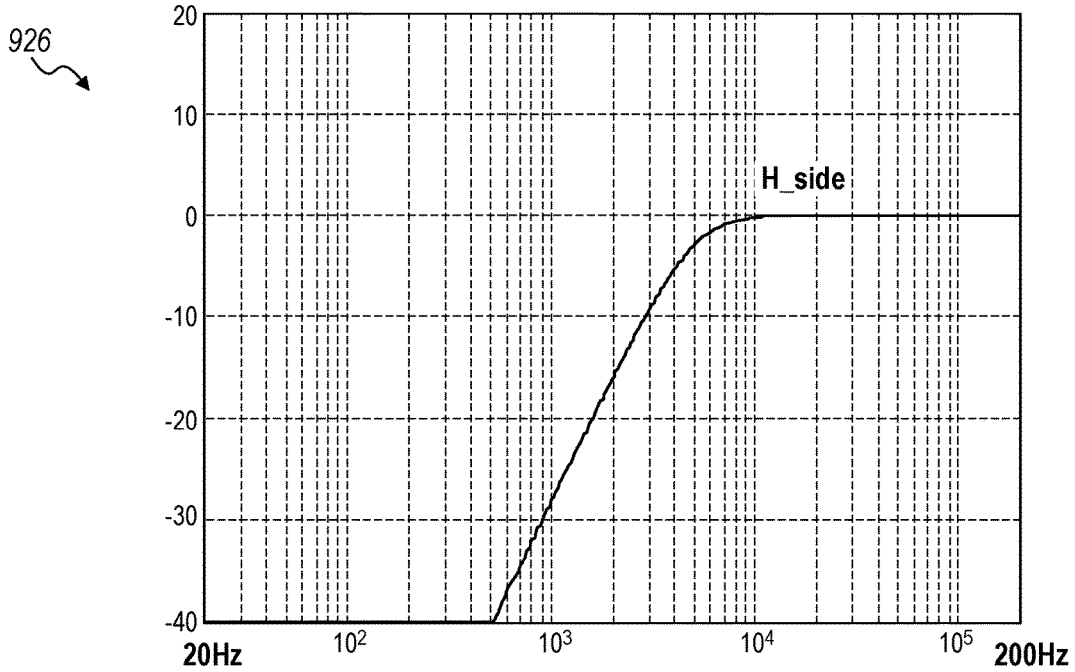
FIG. 9 is a graph illustrating a frequency response of a side-chain filter, according to one or more embodiments of the present disclosure.
Figure 10A:
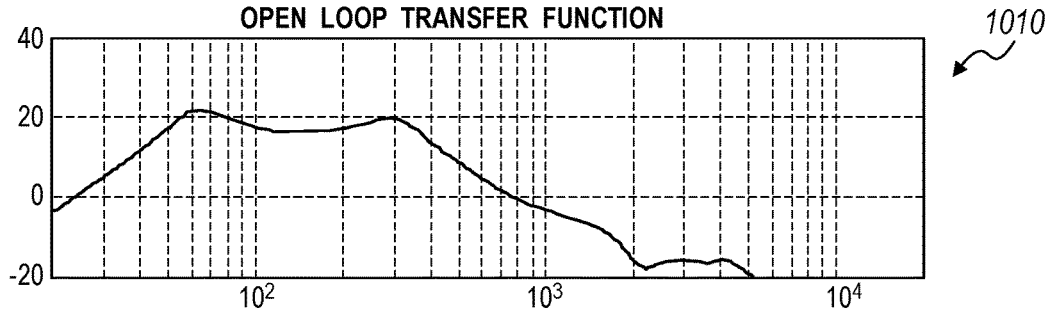
FIG. 10*a* is a graph illustrating a resulting open loop transfer function, according to one or more embodiments of the present disclosure.
Figure 10B:
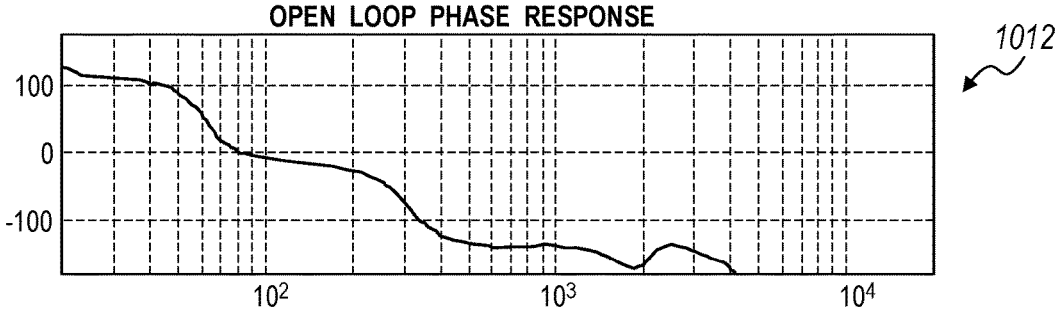
FIG. 10*b* is a graph illustrating a resulting open loop phase response, according to one or more embodiments of the present disclosure.
Figure 10C:
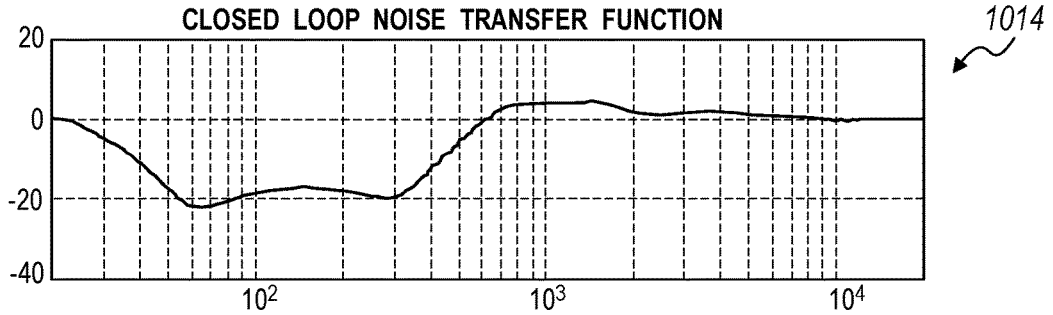
FIG. 10*c* is a graph illustrating a resulting closed-loop noise canceling and distortion reduction performance, according to one or more embodiments of the present disclosure.
Figure 10D:
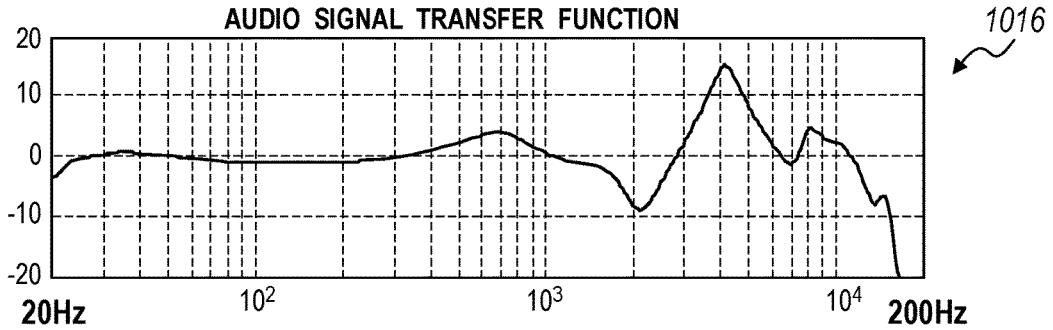
FIG. 10*d* is a graph illustrating a resulting audio signal transfer function, according to one or more embodiments of the present disclosure.

FIG. 8 and FIG. 9 show exemplary loop filters 818 and side chain filters 926, respectively, as may be employed in the control loop 710. As shown in FIG. 9, the side chain filter 734 may be a high-pass filter. FIGS. 10*a-d* shows the resulting performance of the ANC control system 110 using Bode plots. In particular, FIG. 10*a* shows the resulting open loop transfer function 1010. FIG. 10*b* shows the resulting open loop phase response 1012. FIG. 10*c* shows the resulting closed-loop noise canceling and distortion reduction performance 1014. FIG. 10*d* shows the resulting audio signal transfer function 1016, illustrating a flat frequency response between 20 Hz and 1 KHz. As mentioned above, an EQ filter may flatten the response at high frequencies.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A headphone assembly comprising:

a headband; and at least one headphone attached to an end of the headband and including:

an earpiece shaped and positioned for placement into a concha of a user's ear;

memory foam attached to the earpiece; and an acoustically transparent outer foam disposed on the earpiece over top the memory foam;

wherein the headband provides a clamping force that creates an air seal between the headphone and corresponding concha without the headphone intruding into a user's ear canal.

2. The headphone assembly of claim 1, wherein the earpiece includes a transducer and at least one microphone in proximity to the transducer to receive sound radiated by the transducer and noise.

3. The headphone assembly of claim 2, further comprising:

an active noise canceling (ANC) control system configured to receive an audio input signal from an audio source and provide a filtered audio output signal to the transducer based in part on a perceived frequency response of the headphone as measured by the microphone.

4. The headphone assembly of claim 1, wherein the earpiece includes an inner first portion and an outer second portion disposed between the inner first portion and the end of the headphone, the inner first portion defining a first chamber of the earpiece and the outer second portion defining a second chamber of the earpiece.

5. The headphone assembly of claim 4, wherein the memory foam is a self-adhesive strip of memory foam wrapped around the first portion of the earpiece.

6. The headphone assembly of claim 4, wherein the inner first portion of the earpiece is shaped to fit different concha sizes and shapes to provide a universal fit.

7. The headphone assembly of claim 4, wherein the inner first portion of the earpiece includes a perforated nozzle to provide a sound output port.

8. A sound system comprising:

a headphone assembly including:

a headband, and at least one headphone attached to an end of the headband, the headphone including:

an earpiece shaped and positioned for placement into a concha of a user's ear, the earpiece having an inner first portion and an outer second portion disposed between the first portion and the end of the headphone, the inner first portion defining a first chamber of the earpiece and the outer second portion defining a second chamber of the earpiece, a transducer disposed in the second chamber and supported by the outer second portion of the earpiece, a microphone disposed in the first chamber and coupled to the inner first portion of the earpiece, the microphone positioned in the first chamber to receive sound radiated by the transducer and noise, memory foam adhesively attached to the inner first portion of the earpiece, and an acoustically transparent outer foam disposed on the inner first portion of the earpiece over top the memory foam; and an active noise canceling (ANC) control system configured to receive an audio input signal from an audio source and to provide a filtered audio output signal to the transducer based in part on a perceived frequency response of the headphone as measured by the microphone;

wherein the headband provides a clamping force that creates an air seal between the headphone and corresponding concha.

9. The sound system of claim 8, wherein a volume around the microphone is occupied with acoustic foam to dampen internal reflections.

10. The sound system of claim 8, wherein the second chamber includes damping material to dampen a rear acoustic output of the transducer.

11. The sound system of claim 8, wherein the transducer includes a cone formed from a rigid paper membrane to achieve pistonic motion within an audio band.

12. The sound system of claim 8, wherein the outer second portion includes a plurality of vent holes for bass tuning.

13. The sound system of claim 12, wherein the plurality of vent holes are lined with acoustic resistance paper.

14. The sound system of claim 8, wherein the ANC control system includes a side-chain filter configured to pass a high-frequency portion of the audio input signal and a loop filter configured to generate the filtered audio output signal based on a high-pass filtered audio input signal and a feedback signal indicative of sound received by the microphone, and to provide the filtered audio output signal to the transducer.

15. The sound system of claim 14, wherein the side-chain filter is a high-pass filter.

16. A sound system comprising:

a headphone assembly including at least one concha headphone having an earpiece shaped for placement within a concha of a user's ear and a headband that provides a clamping force to seal the user's concha with the headphone, the earpiece including a transducer and at least one microphone;

a side-chain filter configured to high-pass filter an audio input signal; and a loop filter configured to generate a filtered audio output signal based on the high-pass filtered audio input signal and a feedback signal indicative of sound received by the at least one microphone, and to provide the filtered audio output signal to the transducer.

17. The sound system of claim 16, wherein the side-chain filter is a high-pass filter.

18. The sound system of claim 16, wherein the at least one microphone is positioned inside the earpiece to receive sound radiated by the transducer and noise.

19. The sound system of claim 16, wherein the earpiece is shaped to fit different concha sizes and shapes to provide a universal fit.

* * * * *